US007100838B1

(12) United States Patent
Epstein

(10) Patent No.: US 7,100,838 B1
(45) Date of Patent: Sep. 5, 2006

(54) NOVELTY STRAW AND ASSOCIATED METHOD OF OPERATION

(76) Inventor: Stephen T. Epstein, 10 Lakeview Dr., Newtown, PA (US) 18940

( * ) Notice: Subject to any disclaimer, the term of this patent is extended or adjusted under 35 U.S.C. 154(b) by 198 days.

(21) Appl. No.: 10/869,772

(22) Filed: Jun. 17, 2004

(51) Int. Cl.
*A47G 21/18* (2006.01)
*A61J 15/00* (2006.01)

(52) U.S. Cl. ..... 239/33; 239/24; 239/1; 239/12; 239/DIG. 11

(58) Field of Classification Search ..... 239/1, 239/12, 24, 33, 487, 488, DIG. 11
See application file for complete search history.

(56) References Cited

U.S. PATENT DOCUMENTS 2,811,808 A * 11/1957 Briese ..... 446/72
3,332,622 A 7/1967 Lombard
3,782,028 A * 1/1974 Kelly ..... 446/200
4,252,273 A * 2/1981 Karterman ..... 239/33
4,733,785 A * 3/1988 Turner et al. ..... 215/229
5,713,664 A * 2/1998 Harilela ..... 366/129
6,234,342 B1 * 5/2001 Cornell et al. ..... 220/706
6,354,460 B1 * 3/2002 Cornell et al. ..... 220/706
2003/0132307 A1 * 7/2003 Park ..... 239/33

* cited by examiner

*Primary Examiner*—David A. Scherbel
*Assistant Examiner*—Trevor McGraw
(74) *Attorney, Agent, or Firm*—LaMorte & Associates

(57) ABSTRACT

A novelty drinking straw assembly and its method of construction. The drinking straw assembly has a straw tube through which fluid is drawn. A first magnet is disposed within the straw tube. The first magnet is part of a rotor mechanism that rotates when fluid is drawn through the straw tube. A novelty object is disposed around a section of the straw tube. The novelty object has at least one second magnet. The magnets in the novelty object interact with the first magnet contained within the straw tube. This magnetic field interaction causes the novelty object to move about the straw tube whenever the straw is in use and the first magnet is rotating within the straw tube.

19 Claims, 3 Drawing Sheets

NOVELTY STRAW AND ASSOCIATED METHOD OF OPERATION

BACKGROUND OF THE INVENTION

1. Field of the Invention

In general, the present invention relates to novelty straws that are used to drink beverages. More particularly, the present invention is related to straws, where the flow of fluid through the straw is utilized to create mechanical motion of a secondary object.

2. Background Art

Drinking straws have been utilized by people throughout recorded history. In this long period of time there have been many inventions that relate to drinking straws. The prior art history is therefore replete with references that address different straw designs and styles.

Generally speaking, a straw is a tube having one end that can be placed in a beverage. A person brings the straw to their mouth and draws the beverage into their mouth through the structure of the straw. Since a straw allows a person to drink without having to lift a full cup, straws are often provided to children who have difficulty handling a cup or beverage can without spilling its contents. Since straws are particularly popular with children, straws have often been formed into unusual shapes in order to increase the novelty of the straw and its appeal to a child. For example, straws have commonly been made with multiple turns and loops. A child can then watch the progress of a fluid flowing through the turns of the straw while drinking through the straw.

In a few prior art straw designs, the flow of fluid through the straw is used to cause movement of decorative elements contained within a straw. For instance, in U.S. Pat. No. 4,252,273 to Karterman, entitled Amusement Drinking Straw, a straw is shown having an internal rotor. The rotor rotates within the straw as liquid flows past the rotor.

In other prior art straw patents, the flow of liquid through the straw is converted into mechanical energy that is used to move an object that is external to the straw. Such prior art straws are exemplified by U.S. Pat. No. 3,332,622 to Lombard, entitled Drinking Straw. With such prior art drinking straw designs, a rotor is positioned within the straw. The rotor turns a shaft that extends out through the side of the straw. The shaft then is used to turn an external object that is attached to the exterior of the straw.

A problem shared by all such prior art straws that have external moving elements, is that a hole must be formed through the structure of the straw in order for a rotating shaft to pass out of the straw. This hole may allow liquid to leak or even squirt out of the straw while the straw is being used. Furthermore, the thin wall structure of the straw is used as the support for the rotating shaft as it extends out of the straw. Consequently, if the external moving element is pushed, pulled, stopped or otherwise contacted, the force is received by the thin wall of the straw. Thus, even the smallest of forces received by the shaft can cause damage to the structure of the straw. The straw must therefore be manufactured with a reinforced wall or it should be expected that the novelty straw structure will only function for a short time before it breaks.

A need therefore exists for a new novelty straw design that has moving elements that are external to the straw, yet is structurally strong and highly resistant to damage. This need is met by the present invention as it is described and claimed below.

SUMMARY OF THE INVENTION

The present invention is a novelty drinking straw assembly and its method of construction. The drinking straw assembly has a straw tube through which fluid is drawn. A first magnet is disposed within the straw tube. The first magnet is part of a rotor mechanism that rotates when fluid is drawn through the straw tube.

A novelty object is disposed around a section of the straw tube. The object is free to rotate about the straw tube. The novelty object has at least one second magnet. The magnets in the novelty object interact with the first magnet contained within the straw tube. This magnetic field interaction causes the novelty object to move about the straw tube whenever the straw is in use and the first magnet is rotating within the straw tube.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

The present invention straw assembly has an external feature that rotates when fluid flows through the straw. However, there is no direct mechanical interconnection between the straw and the external feature. As a consequence, forces that act upon the external feature are not transferred to the structure of the straw and a highly damage resistant system is produced.

Figure 1:
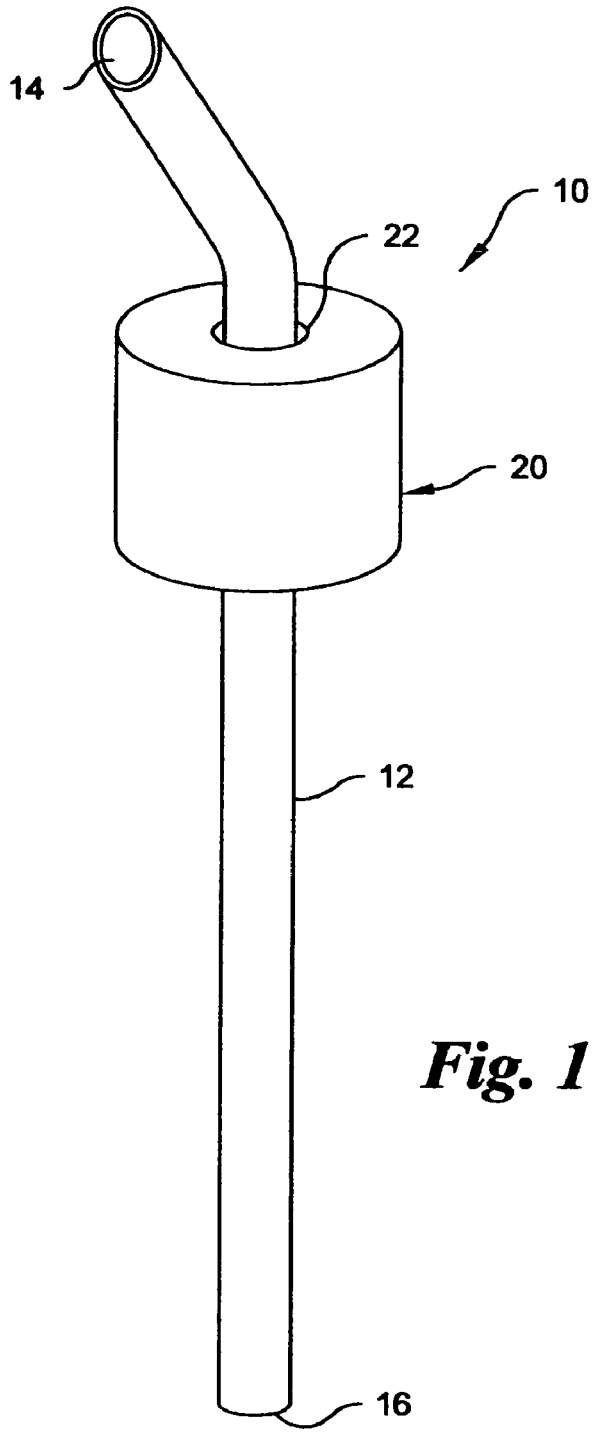
FIG. 1 is a perspective view of an exemplary embodiment of the present invention straw assembly.

Referring to FIG. 1, an exemplary embodiment of a straw assembly 10 is shown. In this embodiment, there is a straw tube 12. The straw tube 12 has an open top end 14 and an open bottom end 16. Liquid can be drawn through the straw tube 12 when the straw assembly 10 is used to drink a fluid.

A secondary object 20 is disposed around the straw tube 12 at a point proximate the open top end 14 of the straw tube. The secondary object 20 is symmetrically formed around a central conduit 22. The straw tube 12 passes through the central conduit 22 of the secondary object 20. As will later be explained in more detail, the secondary object 20 is supported by the straw tube 12 but is not mechanically connected to the straw tube 12. Consequently, the secondary object 20 is free to rotate around the straw tube 12.

In the shown embodiment, the secondary object 20 is shaped as a simple cylinder. However, such a shape is merely exemplary. The secondary object 20 can be shaped as any object, such as a cartoon character, a clown head, an animal or the like. Any shape can be used. However, the secondary object 20 must be relatively evenly balanced in symmetry around the central conduit 22. In this manner, the secondary object 20 will spin in balance around the straw tube 12.

Figure 2:
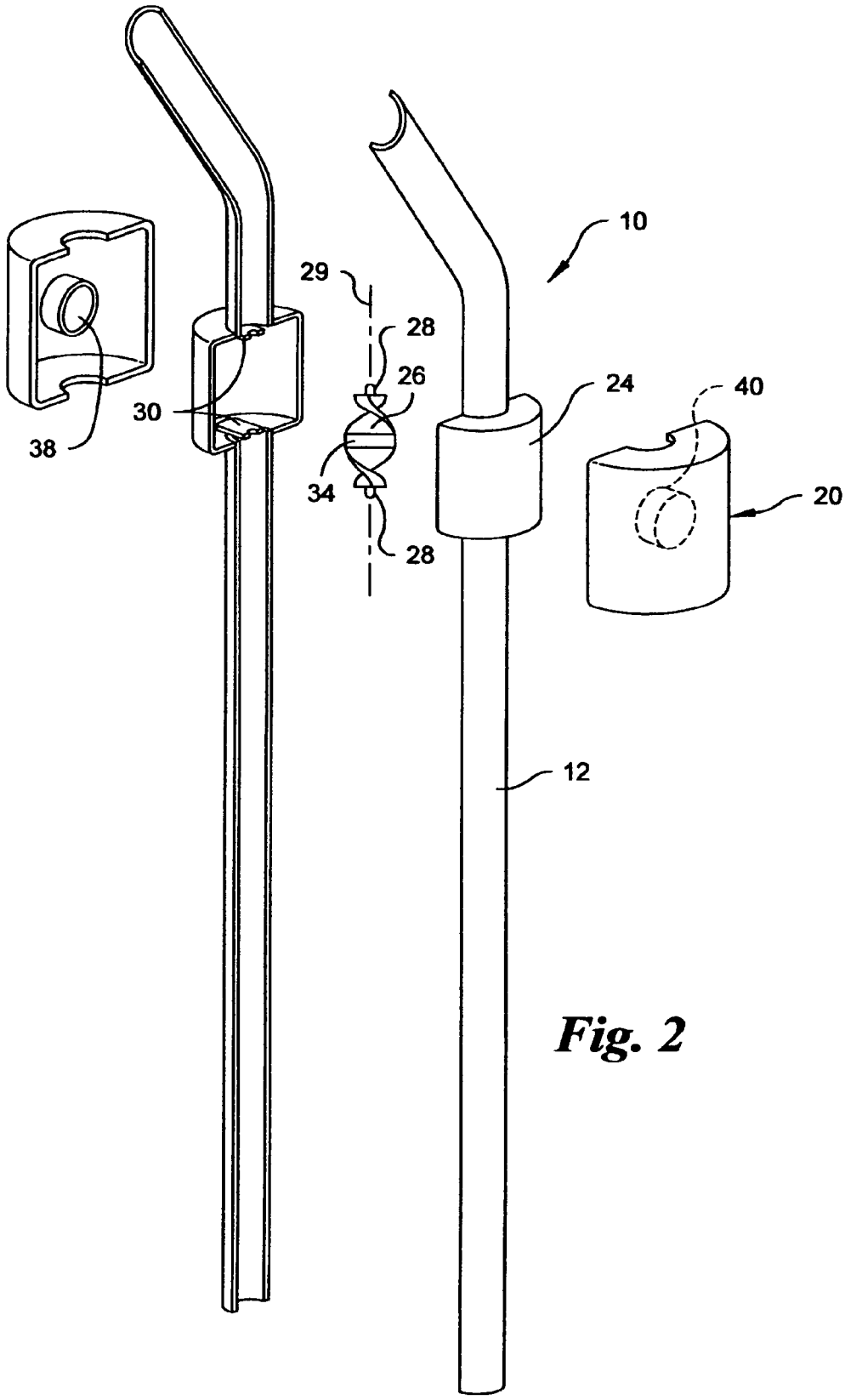
FIG. 2 is an exploded view of the embodiment of the straw assembly shown in FIG. 1.

Referring to FIG. 2, it can be seen, that the straw tube has an enlarged section 24, where both the interior and exterior diameters of the straw tube are expanded. A rotor 26 is provided that mounts within the enlarged section 24 of the straw tube 12. The rotor 26 is helical in shape and has axis pins 28 that extend from the top end and the bottom end of the rotor 26. The helical shape of the rotor 26 winds around an imaginary longitudinal axis 29. The axis pins 28 lay along this longitudinal axis 29.

Support posts 30 extends inwardly into the enlarged section 24 of the straw tube 12. The support posts 30 engage the axis pins 28 of the rotor 26 and support the rotor 26 within the enlarged section 24 of the straw tube 12 so that the rotor 26 is free to rotate within the enlarged section 24 of the straw tube 12.

The rotor 26 is oriented within the enlarged section 24 of the straw tube 12 so that the rotor 26 will rotate when fluid flows through the straw tube 12 in either direction. Consequently, the rotor 26 turns whenever either air or fluid is drawn through the straw tube 12.

A magnet 34 is present in the center of the rotor 26. The magnet 34 has a positive pole and an opposite negative pole that are positioned on opposite sides of the longitudinal axis 29 of the rotor 26. The magnet 34 is balanced about the longitudinal axis 29 of the rotor. As a result, the positive and negative poles of the magnet 34 freely rotate around the longitudinal axis 29 of rotor 26 as the rotor spins.

The secondary object 20 defines a central conduit 22 that has a diameter that is larger than the primary diameter of the straw tube 12, but smaller than the diameter of the enlarged section 24 of the straw tube 12. As a consequence, when the secondary object 20 is placed over the enlarged section 24 of the straw tube 12, the secondary object 20 is prevented from moving up and down along the straw tube 12 by contact with the enlarged section 24 of the straw tube 12.

Two additional magnets 38, 40 are also disposed within the secondary object 20 that cause the secondary object 20 to rotate. The two magnets 38, 40 are disposed on opposite sides of the secondary object 20. One magnet 38 has its positive pole facing inwardly toward the straw tube 12. The opposite magnet 40 has its negative pole facing inwardly toward the straw tube 12. The two magnets 38, 40 are held in place by the structure of the secondary object 20 and always are disposed on opposite sides of the central conduit 22.

Figure 3:
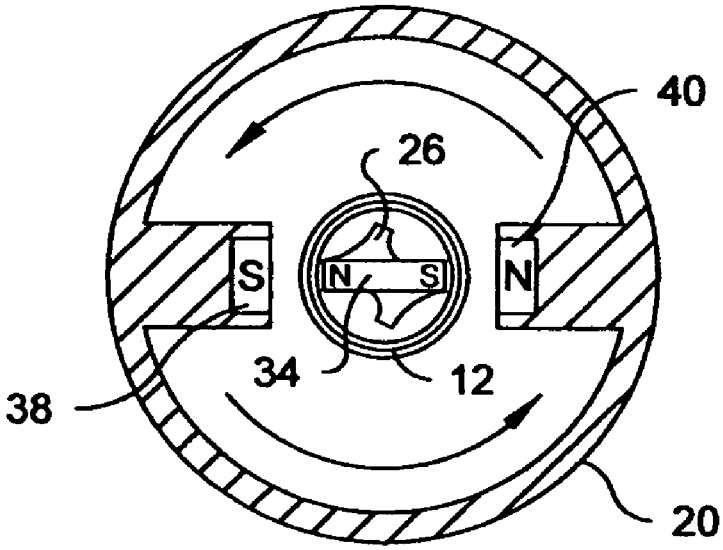
FIG. 3 is top cross-sectional view of the embodiment of the straw assembly shown in FIG. 1 and FIG. 2.

Referring to FIG. 3, it can be seen that as the rotor 26 rotates within the straw tube 12, the positive and negative poles of the rotor magnet 34 also rotate. As the rotor magnet 34 rotates, the positive and negative poles of the rotor magnet 34 rotate past the magnets 38, 40 set into the secondary object 20. The negative pole of the rotor magnet 34 attracts to the positive object magnet 38. Similarly, the positive pole of the rotor magnet 34 attracts to the negative object magnet 40. Thus, the object magnets 38, 40 are biased into a specific orientation with respect to the rotor 26 within the straw tube 12, due to the interacting magnetic fields. As a consequence, when the rotor 26 is caused to rotate within the tube straw 12, the secondary object 20 is caused to rotate with the rotor 26 in order to maintain the same orientation with respect to the rotor 26.

Although the secondary object 20 is biased by the forces of the magnetic fields to follow the rotation of the rotor 26, the secondary object 20 is not mechanically connected to the rotor 26 or even the straw tube 12 that surrounds the rotor 26. Consequently, the secondary object 20 can be touched and suddenly stopped from rotating without any damage to the rotor 26 or the straw tube 12.

Returning to FIG. 1, it can now be understood that when a person draws a fluid through the tube straw 12, the rotor 26 within the tube straw 12 will spin. The spinning rotor 26 creates a moving magnetic field that interacts with the object magnets 38, 40 within the secondary object 20. The interacting magnetic fields create a rotating force within the secondary object 20 that causes the secondary object 20 to rotate around the straw tube 12. However, the secondary object 20 is not directly interconnected with the straw tube 12. As a result, it can be impacted and stopped without damaging the straw tube 12 or the rotor 26 within the straw tube 12.

It will be understood that the embodiment of the present invention illustrated and described is merely exemplary and that a person skilled in the art can make many variations to the shown embodiment using functionally equivalent components. For example, the size, shape and location of the secondary object can be altered. The length, diameter and shape of the straw tube can also be varied. Furthermore, variations can be made in the length and shape of the rotor used to spin a magnet within the straw tube. All such alterations, modifications and alternate embodiments are intended to be included within the scope of the present invention as defined by the claims.

What is claimed is:

1. A drinking straw assembly, comprising:

a straw tube;

a first magnet disposed in said straw tube that rotates when fluid is drawn through said straw tube;

an object disposed around said straw tube that is free to rotate about said straw tube, said object having at least one second magnet that interacts with said first magnet causing said object to move about said straw tube when said first magnet rotates within said straw tube.

2. The assembly according to claim 1, further including a rotor disposed within said straw tube that rotates when fluid flows through said straw tube, wherein said first magnet is coupled to said rotor.

3. The assembly according to claim 1, wherein said straw tube has an enlarged section and said first magnet is disposed within said enlarged section.

4. The assembly according to claim 3, wherein said object is disposed around said enlarged section of said straw tube.

5. The assembly according to claim 1, wherein said first magnet rotates about an axis within said straw tube and said first magnet has a positive pole and a negative pole that are symmetrically disposed on opposite sides of said axis.

6. The assembly according to claim 1, wherein said object defines a central opening through which said straw tube passes.

7. The assembly according to claim 6, wherein said object is symmetrically balanced about said central opening.

8. The assembly according to claim 7, wherein said object contains multiple second magnets that are symmetrically disposed around said central opening.

9. The assembly according to claim 7, wherein said object contains two second magnets disposed on opposite sides of said central opening, wherein said two second magnets have opposite poles facing said central opening.

10. A method of making a novelty object rotate about a drinking straw when the drinking straw is in use, said method comprising the steps of:

providing a drinking straw;

providing a first magnet within said drinking straw that rotates when fluid is drawn through said drinking straw;

providing an object that surrounds a portion of said drinking straw, wherein said object contains at least one second magnet that interacts with said first magnet in said drinking straw, thereby causing said object to move about said drinking straw when said first straw rotates within said drinking straw.

11. The method according to claim 10, wherein said step of providing a first magnet within said drinking straw includes providing a rotor that is rotated by fluid flowing through said drinking straw, wherein said first magnet is coupled to said rotor and rotates with said rotor.

12. The method according to claim 10, wherein said step of providing a drinking straw includes providing a drinking straw having an enlarged section, wherein said first magnet is disposed in said enlarged section.

13. The method according to claim 12, wherein said step of providing an object that surrounds a portion of said drinking straw, includes placing said object around said enlarged section of said drinking straw, wherein said enlarged section retains said object in place around said drinking straw.

14. The method according to claim 10, wherein said step of providing an object includes providing an object with a central opening wherein said object is symmetrically balanced about said central opening.

15. The method according to claim 14, wherein said step of providing an object further includes providing an object having magnets disposed on opposite sides of said central opening, wherein each of said magnets has an opposite pole facing said central opening.

16. A drinking straw assembly, comprising:

a straw tube through which fluid can be drawn;

an object having a central opening through which said straw tube passes;

wherein said object rotates around said straw tube when fluid is drawn through said straw tube.

17. The assembly according to claim 16, wherein said object is caused to rotate about said straw tube by a magnetic field.

18. The assembly according to claim 16, further including a magnet disposed in said straw tube that rotates within said straw tube when fluid flows through said straw tube.

19. The assembly according to claim 16, wherein said object is symmetrically balanced around said central opening.

* * * * *